United States Patent [19]

Goodman

[11] 4,161,736

[45] Jul. 17, 1979

[54] DIRECTION FINDING ANTENNA AND SYSTEM

[76] Inventor: David J. Goodman, 3305 DeSota Ave., Cleveland Heights, Ohio 44118

[21] Appl. No.: 943,331

[22] Filed: Sep. 18, 1978

Related U.S. Application Data

[63] Continuation-in-part of Ser. No. 758,591, Jan. 12, 1977, Pat. No. 4,115,780.

[51] Int. Cl.[2] ..... H01Q 1/48; H01Q 21/08

[52] U.S. Cl. ..... 343/739; 343/845; 343/853

[58] Field of Search ..... 343/712, 739, 830, 845, 343/846, 853

[56] References Cited

U.S. PATENT DOCUMENTS 3,289,208 11/1966 Hollingsworth ..... 343/845

*Primary Examiner*—Eli Lieberman

*Attorney, Agent, or Firm*—Richard H. Thomas

[57] ABSTRACT

A broad band antenna suitable for mounting on a ground plane comprises a pair of spaced-apart, linear hollow monopoles perpendicular to the ground plane and an air-dielectric coaxial transmission line extending linearly between the monopoles parallel to the ground plane. Means are provided grounding the outer conductor of the transmission line to the ground plane, the inner conductor top-connecting the monopoles.

8 Claims, 3 Drawing Figures

DIRECTION FINDING ANTENNA AND SYSTEM

This application is a continuation-in-part of prior application Ser. No. 758,591, filed Jan. 12, 1977, now U.S. Pat. No. 4,115,780.

BACKGROUND OF THE PRESENT INVENTION

The present invention relates generally to antennas, and more particularly to a novel direction finding antenna of the type comprising two short spaced-apart monopole antennas top-connected by a transmission line.

In the field of antennas, it has been general practice to employ antennas which are narrow banded and exhibit widely variable impedance characteristics with respect to frequency. Further, antennas of similar appearance, exemplary of the prior art, often incorporate a terminating capacitor with one end grounded to the conducting surface, tending to limit the use of the antenna to a narrow range of radio frequencies, usually requiring adjustment of the capacitor for each separate frequency of operation.

It is known in the art to employ a U-shaped bar antenna, referred to as a "towel bar" antenna, as a homing device for aircraft. A single such antenna, marketed by Dorne and Margolin, Inc., is mounted on an aircraft, transverse to the direction of movement or flight path of the aircraft. Leads are connected from both ends of the antenna to a receiver and a signal processing circuit designed to terminate one end and feed the other end, and then reverse the connections, so that the directivity of the antenna is repeatedly switched 180°. The fuselage of the aircraft serves as ground plane for the antenna.

In operation, the signal processing circuit for the system converts a signal received from a radio transmitter into alternate left- and right-looking antenna patterns. If the vehicle veers to the right or left of the direction to the transmitting source, this deviation is detected by the processing circuit and the appropriate error is displayed on a meter which is part of the circuit.

The problem with a U-shaped bar antenna, consisting of an open transmission line above a ground plane, is that the horizontal transmission line member of the antenna has to be a very specific, and therefore limited, height from the ground plane in order for the antenna output to be a practical impedance, necessary in matching the antenna to the receiver circuit. In the case of the Dorne and Margolin, Inc. "towel bar" antenna, the height from the ground plane was about 6 inches. A matching transformer was required at the antenna output, in order to match its impedance to the associated receiver. Such limited height adversely affects the signal pickup capability of the antenna. Even under the best of conditions, radio direction finding is subject to error. Things such as vehicle shape, propeller interference, other antennas mounted on the vehicle, all contribute to reading error. Every antenna pattern also changes shape as the frequency changes, further reducing reading accuracy. The worst condition is with mobile land direction finding. Very sizable errors are produced by the addition and cancellation of radio waves due to reflections from buildings, electric lines, roadways, cars, and trees as the vehicle moves along.

In prior application Ser. No. 758,591, there is disclosed a direction finding antenna system comprising a plurality of U-shaped antennas, each consisting essentially of three electrically active elements. One of the elements is an open transmission line spaced above and parallel to a ground plane, the other two being spaced-apart monopoles top-connected by the open transmission line. One of the monopoles preferably is connected to the ground plane by a terminating resistor, defining the antenna terminated end, the other monopole being connected to a receiver through an impedance transformer, defining the antenna output end. The plurality of the antennas are radially positioned about a central point with the output ends outboard of the terminated ends and uniformly spaced from each other.

In operation, a radio signal from a remote source impinges first on the monopole of an antenna closest to that signal, and induces a current in the monopole which is then conducted by the transmission line to the second monopole of that antenna. By virtue of this conduction, and the fact that the monopoles are top-connected, a current exists in the second monopole which is out of phase with respect to a current induced in the second monopole by the signal directly received. The two currents cancel each other. If the signal is to the right or left of the antenna alignment, the cancellation of currents is less than complete. By employing an array of antennas as described and a receiving circuit adapted to resolve the outputs of the multiple antennas, the exact direction toward the signal is determined.

BRIEF DESCRIPTION OF THE PRESENT INVENTION

In the present invention, the above and other disadvantages faced by the use of a conventional U-shaped bar antenna are overcome in the provision of an antenna comprising spaced-apart monopoles in the form of hollow members perpendicular to a ground plane, top-connected by the inner conductor of a coaxial air-dielectric transmission line. The outer conductor of the coaxial transmission line is grounded to the ground plane by at least one ground lead running within a hollow monopole.

Preferably the monopoles and ground leads are the outer and inner conductors, respectively, of air-dielectric coaxial line. In a specific, preferred embodiment of the present invention, both monopoles are constructed of air-dielectric coaxial line which are of the same cross-section.

Preferably one monopole is, as with the antenna system of prior application Ser. No. 758,591, connected to ground by a terminating resistor of characteristic impedance, defining the antenna terminated end, the other monopole being connected to a receiver circuit through a coaxial connection, defining the antenna output end. A plurality of the antennas preferably are radially positioned in an array about a central point, equally spaced apart, with the output ends outboard of the terminated ends. A signal received by an antenna monopole closest to a radio signal source is conducted to the monopole of that antenna spaced from it by the coaxial transmission line. As with the antenna system of prior application Ser. No. 758,591, depending upon the orientation of the antenna with regard to the source, there is a partial or complete cancellation of currents in the antenna, producing an output, which, when resolved by the receiver circuit with outputs of other antennas of the array, gives the exact azimuthal direction of the signal source.

One advantage of the present invention is that the coaxial transmission lines of the antennas provide antenna impedances matching the characteristic impedance of a receiver or processing circuit, and the distance from the ground plane of the horizontal transmission line is no longer a critical factor. Thus the monopoles can be made longer, greatly increasing antenna signal pickup. The impedance matching transformer of prior embodiments is eliminated with the present invention, since the entire antenna operates at the characteristic impedance of the receiver or processing circuit.

DETAILED DESCRIPTION OF THE PRESENT INVENTION

The present invention and advantages thereof will become more apparent from the following detailed description of the invention, with reference to the accompanying drawings, in which.

Figure 1:
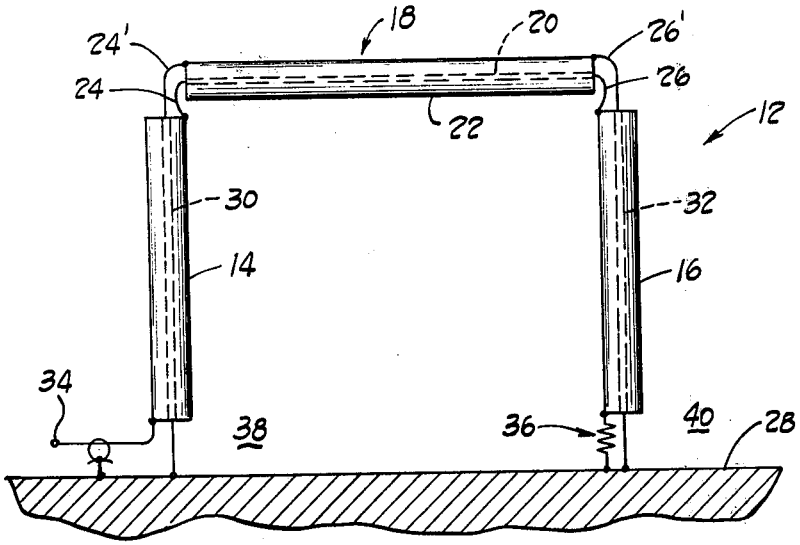
FIG. 1 is an elevation view of an antenna in accordance with the concepts of the present invention.

Referring to FIG. 1, the antenna 12 of the present invention comprises primarily three electrically active elements, a pair of spaced-apart hollow monopoles 14 and 16, and a coaxial transmission line 18 extending between the monopoles. The coaxial transmission line 18 is comprised of an air-dielectric line section having inner and outer conductors 20 and 22, the inner conductor 20 top-connecting the monopoles by connections 24 and 26. The outer conductor 22 is grounded to a ground plane 28, at its opposite ends, by connections 24' and 26' leading to ground conductors 30 and 32, the latter running within the hollow monopoles 14 and 16, respectively.

In the embodiment illustrated in FIG. 1, the monopoles 14 and 16 are also air-dielectric sections of the same materials and cross-section as the coaxial transmission line 18. A typical construction, in accordance with the concepts of the present invention, employs a 50 ohm rigid coaxial line.

Also in the embodiment illustrated, the monopole 14 is connected to a receiver circuit (not shown) by a coaxial connection 34, the monopole 16 being connected to ground through a resistance 36, equal to the characteristic impedance of the receiver input circuit. This defines the output end 38 and terminated end 40, respectively, of the antenna. It also establishes the characteristic cardioid lobe facing outwardly from the antenna, in the direction from the terminated end 40 to the output end 38.

By connecting the horizontal transmission line section 18 to the ground plane 28 by employing the inner conductors 30 and 32 of the vertical monopoles as ground leads, such leads are kept out of the pattern of the antenna. This permits top-connecting the monopoles with the coaxial line section and maintaining the outer conductor 22 of the coaxial line section at r.f. ground potential even though physically remote from the ground plane.

In operation, if an electromagnetic radio signal impinges first upon the monopole 16 at the antenna terminated end, this induces a current in the monopole which flows in the same direction as the signal via the inner conductor 20 of the coaxial transmission line 18 to the companion monopole 14 at the antenna output end. Similarly, the radio signal travelling through space also induces a current at the output end of monopole 14 which opposes the conducted current arriving via the transmission line 18. The currents are partially or substantially 180° out of phase with respect to each other, depending upon the orientation of the antenna with respect to the direction to the arriving signal, with the net result that the two currents partially or substantially cancel each other.

If the antenna is aligned exactly with the arriving signal, the velocity of the conducted current flow in the transmission line 18 is the same as the velocity of the radio signal passing through free space, since the transmission line uses air as its dielectric medium. Thus there would be no time delay between the arrival of the conducted current and the arrival of the radio signal at the output end of monopole 14. The current induced in the monopole 14 as a result of the arrival of the radio signal will be substantially 180° out of phase with the conducted current and the cancellation will be essentially complete. Thus, the radiation pattern for the antenna will exhibit a null in the direction of the terminating resistor 36.

If the radio signal arrives at the antenna 12 from either the right or the left of the antenna, the difference in the signal arrival time for monopoles 14 and 16 will vary and the phase relationship between these members will likewise vary. The phase relationship which previously produced complete cancellation of a signal will no longer exist and a signal will appear at the antenna output 34.

The greatest difference in radio signal arrival time will occur when the radio signal is arriving in the direction from the output end 38 to the terminated end 40, wherein the least amount of cancellation occurs. Thus the antenna will exhibit maximum output in this instance. For signals arriving from other directions, the output of the antenna will be some specific intermediate value corresponding to the signal from that direction.

Figure 2:
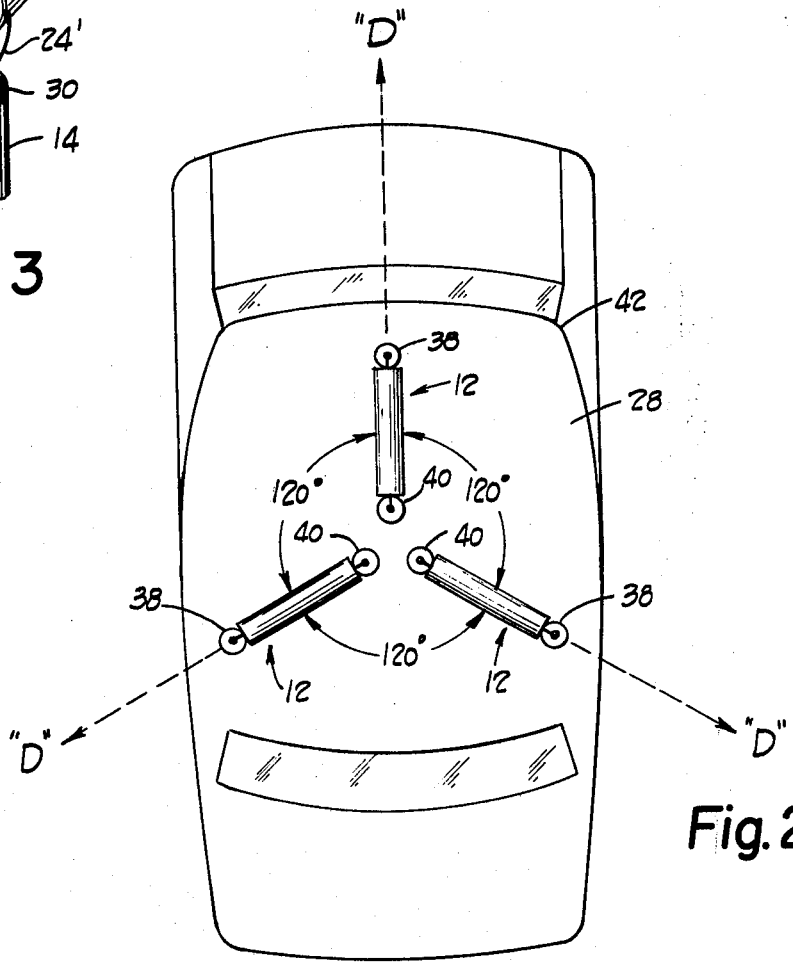
FIG. 2 is a plan view of an array of the antennas of FIG. 1 mounted on the roof of a car.

The antenna 12 is especially applicable for use in a multiple antenna arrangement as shown in FIG. 2, a plan view wherein three of the previously described antennas are oriented radially in three different directions, 120° apart. In the specific arrangement shown in FIG. 2, the ground 28 is the metal roof of a vehicle 42. The arrangement of antennas is such that the terminated end 40 of each antenna is near a central point on the vehicle roof, with the output ends 38 being separated from each other by an angle of 120°.

By utilizing this particular arrangement of antennas, the lobes of the antenna patterns are directed outward away from the vehicle and away from the other individual antennas resulting in minimized interaction between the antennas. None of the antennas are located in the lobe of any other antenna, and the terminated ends are closely grouped providing a compact assembly. Each arrow in FIG. 2 identified with the letter "D" indicates the direction of maximum reception for each respective antenna.

The antenna of the present invention and arrangement of antennas are particularly well suited for direction finding. In operation, the outputs of the three antennas are sampled by a suitable receiver circuit (not shown), and the resultant signals are processed and applied to a display providing a bearing in the azimuth from the vehicle indicating the direction to the source of a radio frequency emission.

By employing a plurality of antennas as shown in FIG. 2, a plurality of outputs will be received by a receiver circuit which when resolved by the circuit will give an accurate direction of location for the signal source. It should be understood, however, that the present invention is not limited to the use of three antennas. Even better accuracy may be obtained from additional antennas, each separated from the other by an equal angle. Alternatively, advantages of the present invention can be realized by the use of just one antenna.

A principal advantage of the present invention is that the pattern of the antenna remains relatively constant over a very broad frequency range since the antenna is electrically small, i.e. all dimensions are small with respect to a wavelength. The cardioid shape of the antenna pattern is derived from the 180° phase relationship between the two vertical monopoles. This phase relationship is physically obtained by top-connecting the two monopoles and not from the physical spacing of the two monopoles as is customary practice. As a result, the antenna will produce the desired cardioid shaped pattern at operating frequencies so low that the spacing between monopoles amounts to a very small fraction of a wavelength. The upper frequency limit of this antenna is reached when the spacing between monopoles is no longer insignificant. This occurs when the spacing becomes a major fraction of a wavelength.

The terminating resistor 36 serves three functions. The resistance is equal to that of the characteristic impedance of the transmission line 18. It insures that current flowing toward the resistor will not be reflected in the opposite direction. Secondly, the resistor insures that the antenna impedance observed at the output end 34 remains substantially constant over the frequency range of the antenna. Third, it is necessary because the antenna is electrically small. If the non-output end were grounded instead of terminated with a resistor, the output impedance of the antenna would become small and would approximate that of a short circuit across the output terminal, markedly reducing a received signal.

Figure 3:
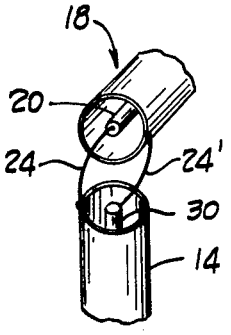
FIG. 3 is a perspective view illustrating schematically the connection of a transmission line and monopole and construction of an antenna in accordance with the concepts of the present invention.

In FIG. 1 and the perspective view of FIG. 3, the connections 24, 24', 26 and 26' between the transmission line 18 and monopoles 14 and 16 (including grounds 30 and 32) are schematically shown as wire leads. In actual practice, they can be part of a pair of transition elements rigidly holding and supporting the transmission line 18 between the monopoles. Quite obviously, the transition elements can be any molded, cast or machined part capable of achieving the functions of both supporting the transmission line by the monopoles and connecting of the component parts as schematically depicted. Alternatively the transition can be accomplished with the use of flexible coaxial cable.

Preferably the monopoles 14 and 16 are also constructed of rigid, air-dielectric coaxial line.

Normally the transmission line 18 will be horizontally oriented parallel to a horizontal ground plane.

It will be understood by those skilled in the art that the antenna of the present invention can be readily adapted for use as the antenna in the homing system marketed by Dorne and Margolin, Inc. referred to above. This can be accomplished by providing output connections at both ends of the antenna and connecting the antenna to a circuit adapted to terminate one end and feed the other, and then reverse the connection, so that the directivity of the antenna is repeatedly switched. The advantages of the present invention will be realized with this arrangement. Namely, the monopoles can be made longer than in the Dorne and Margolin, Inc. "towel bar" antenna, greatly increasing antenna signal pickup. The matching transformers conventionally employed with the prior art are eliminated.

What is claimed is:

1. An antenna comprising two spaced-apart tubular monopoles extending linearly from a ground plane perpendicular to the ground plane;

a coaxial transmission line extending linearly between said monopoles, said transmission line being a dielectric line section comprising inner and outer conductors;

means to top-connect the inner conductor of said transmission line to said monopoles; and ground means grounding the outer conductor to ground, said ground means comprising at least one ground lead extending within one of said monopoles.

2. The antenna of claim 1 wherein said ground means comprises a pair of ground leads extending from opposite ends of the outer conductor of said coaxial transmission line running coaxially within the tubular monopoles and connected to the ground plane.

3. The antenna of claim 2 wherein said monopoles and ground leads are air-dielectric sections of a coaxial line.

4. The antenna of claim 3 wherein said air-dielectric sections of coaxial line of said monopoles are of the same cross-section as said coaxial transmission line.

5. The antenna of claim 4 including a terminating resistor connecting one of said monopoles to ground, defining the antenna terminated end, the opposite end being the antenna output end.

6. A direction finding antenna system comprising a plurality of antennas each having a terminated end and an output end, each terminated end being positioned about a central point on an electrically conductive surface, each output end being outboard from the terminated end and separated from the output ends of the other antennas by an equal angle;

each antenna being U-shaped comprising three electrically active elements, two of said elements being spaced-apart hollow monopoles extending linearly from said conductive surface perpendicular to the conductive surface, the third element being an air-dielectric coaxial transmission line extending linearly between said monopoles;

said transmission line including inner and outer conductors;

the inner conductor top connecting said monopoles; and ground means grounding the outer conductor of said transmission line to said electrically conductive surface.

7. The direction finding antenna system of claim 6 wherein said ground means comprises a pair of ground leads extending from opposite ends of the outer conductor of said coaxial transmission line running within the hollow monopoles.

8. The direction finding antenna system of claim 7 wherein said monopoles and ground leads are air-dielectric sections of a coaxial line.

* * * * *